US011739564B2

(12) United States Patent
Kendall et al.

(10) Patent No.: US 11,739,564 B2
(45) Date of Patent: Aug. 29, 2023

(54) METHOD FOR OPERATING A DOOR AND COMPONENTS RELATED TO THE SAME

(71) Applicant: Endura Products, LLC, Colfax, NC (US)

(72) Inventors: Adam Kendall, Burlington, NC (US); Tomasz Jaskiewicz, Oak Ridge, NC (US)

(73) Assignee: Endura Products, LLC, Colfax, NC (US)

( * ) Notice: Subject to any disclaimer, the term of this patent is extended or adjusted under 35 U.S.C. 154(b) by 264 days.

(21) Appl. No.: 17/181,734

(22) Filed: Feb. 22, 2021

(65) Prior Publication Data

US 2021/0277685 A1 Sep. 9, 2021

Related U.S. Application Data

(60) Provisional application No. 62/985,118, filed on Mar. 4, 2020, provisional application No. 63/092,570, filed on Oct. 16, 2020.

(51) Int. Cl.
*E05B 63/00* (2006.01)
*G07C 9/00* (2020.01)
(Continued)

(52) U.S. Cl.
CPC ..... *E05B 63/0065* (2013.01); *E05B 47/0002* (2013.01); *E05F 1/002* (2013.01);
(Continued)

(58) Field of Classification Search
CPC ..... E05B 63/00; E05B 63/0065; E05B 63/0069; E05B 63/0073; E05B 63/246;
(Continued)

(56) References Cited

U.S. PATENT DOCUMENTS 9,024,759 B2 5/2015 Uyeda et al.
9,328,532 B2 5/2016 Nguyen et al.
(Continued)

FOREIGN PATENT DOCUMENTS

DE 102008008142 8/2009
WO 2017006164 1/2017

OTHER PUBLICATIONS

Kevo Smart Locks, Kwikset, https://www.kwikset.com/kevo, known at least as early as Jan. 20, 2021, 5 pgs.
Notice of Allowance, for U.S. Appl. No. 17/181,714, dated Sep. 28, 2022, 12 pages.

*Primary Examiner* — Nathan Cumar
(74) *Attorney, Agent, or Firm* — Womble Bond Dickinson (US) LLP

(57) ABSTRACT

A method of operating a door system includes sensing a user on an exterior side of a door panel in physical propinquity to the lock such that the lock transitions from a sleep state to an active state, authenticating the user when the lock is in the active state before converting the lock from a locked configuration to an unlocked configuration, and converting the lock from the locked configuration to the unlocked configuration in response to transition to the active state. Authenticating the user includes receiving an authentication signal from a remote device on the user in physical propinquity to the to the lock.

19 Claims, 4 Drawing Sheets

(51) Int. Cl.
*E05B 47/00* (2006.01)
*E05F 1/00* (2006.01)
*E05B 41/00* (2006.01)

(52) U.S. Cl.
CPC ..... *G07C 9/00309* (2013.01); *G07C 9/00714* (2013.01); *G07C 9/00896* (2013.01); *E05B 41/00* (2013.01); *E05B 47/0001* (2013.01); *E05B 2047/0056* (2013.01); *E05B 2047/0094* (2013.01); *E05Y 2900/106* (2013.01); *G07C 2009/00317* (2013.01); *G07C 2009/00928* (2013.01)

(58) Field of Classification Search
CPC ..... E05B 65/00; E05B 65/105; E05B 47/00; E05B 47/0001–0005; E05B 2047/00; E05B 2047/0048; E05B 2047/0056; E05B 2047/0094; E05B 41/00; E05Y 2900/00; E05Y 2900/106; G07C 9/00; G07C 9/00309; G07C 9/00714; G07C 9/00896; G07C 9/00904; G07C 9/00912; G07C 2009/00; G07C 2009/00317; G07C 2009/00325; G07C 2009/00333; G07C 2009/00928
USPC ..... 70/101
See application file for complete search history.

(56) References Cited

U.S. PATENT DOCUMENTS

| | | | | |
|---|---|---|---|---|
| 9,390,572 | B2 | 7/2016 | Almomani et al. | |
| 9,406,181 | B2 | 8/2016 | Almomani et al. | |
| 9,487,971 | B2 | 11/2016 | Quach et al. | |
| 9,512,643 | B1 | 12/2016 | Keefe | |
| 9,670,696 | B2 | 6/2017 | Chong | |
| 9,691,207 | B2 | 6/2017 | Almomani | |
| 9,758,990 | B2 | 9/2017 | Beck | |
| 10,033,972 | B2 | 7/2018 | Almomani et al. | |
| 10,240,365 | B2 | 3/2019 | Almomani et al. | |
| 10,378,238 | B2 | 8/2019 | Beck et al. | |
| 11,060,323 | B2 | 7/2021 | Almomani et al. | |
| 11,066,862 | B1 | 7/2021 | Rowland | |
| 2011/0018680 | A1* | 1/2011 | Lai | E05C 19/166 340/3.1 |
| 2016/0376816 | A1* | 12/2016 | Graham | E05B 65/1013 292/197 |
| 2017/0226784 | A1* | 8/2017 | Davis | E05B 47/00 |
| 2017/0259654 | A1 | 9/2017 | McDonald, II et al. | |
| 2018/0187464 | A1 | 7/2018 | Moon | |
| 2019/0078361 | A1 | 3/2019 | Worden et al. | |
| 2020/0349786 | A1 | 11/2020 | Ho | |
| 2021/0025214 | A1 | 1/2021 | Dora | |

* cited by examiner

METHOD FOR OPERATING A DOOR AND COMPONENTS RELATED TO THE SAME

CROSS-REFERENCE TO RELATED APPLICATIONS

This application claims priority to, and benefit of, U.S. Provisional Patent Application Ser. No. 63/092,570, filed Oct. 16, 2020 and U.S. Provisional Patent Application Ser. No. 62/985,118, filed Mar. 4, 2020. The entire contents of each of the above applications are hereby incorporated by reference.

BACKGROUND

1. Technical Field

The present disclosure relates to doors and, more specifically, to features and components installed within and around a door to unlock or open a door.

2. Discussion of Related Art

Electronic entry door features, such as electronic door locks (e.g., push button, biometric sensor, RFID reader), intercoms, cameras, motion sensors, and lighting, have been provided as modular, battery powered solutions for installation on or near an entry door, to provide additional security and convenience, and may, for example, provide for remote communication with a user (e.g., homeowner, business owner, resident, or employee), for example, through wireless communication (e.g., Wi-Fi or cellular) with the user's cell phone, tablet, or computer.

SUMMARY

In an embodiment of the present disclosure, a method of operating a door system includes receiving a signal from a pressure sensor disposed in a sill or a frame of the door system, authenticating the user after receiving the signal, shifting the lock from a locked configured to an unlocked configuration in response to receiving the signal after authenticating the user, and moving the door panel from a closed position to an ajar position in response to receiving the signal.

In embodiments, shifting the lock from the locked configured to an unlocked configuration includes shifting a first auxiliary latch and a second auxiliary latch from an extended position to a retracted position. Moving the door panel from a closed position to an ajar position may include moving a main latch from a latched position to a retracted position.

In another embodiment of the present disclosure, a method includes receiving a signal or sensing a user with a lock disposed within a door panel, shifting the lock from a locked configuration to an unlocked configuration in response to receiving the signal or sensing the user, and moving the door panel from a closed position to an ajar position in response to receiving the signal or sensing the user.

In embodiments, the method includes moving the door panel from the closed position to the ajar position includes a linear actuator, a motorized strike plate, an electromagnetic mechanism, or an electronic hinge that move the door panel from the closed position to the ajar position. Receiving the signal or sending the user may include sensing the user with the lock.

In some embodiments, the method includes authenticating the user after sending the user with the lock. Authenticating the user may include receiving a signal from a device. The device may be remote to the lock or the door system. Authenticating the user may include determining a position of the device.

In certain embodiments, receiving the signal or sensing the user may include receiving the signal from a pressure sensor disposed in a sill or a frame of the door system. Receiving the signal or sensing the user may include receiving the signal from an ultrasonic receiver, an infaRed receiver, a light curtain sensor, or an audio receiver disposed in the sill or frame of the door system.

In particular embodiments, receiving the signal or sensing the user includes receiving the signal from a garage door opener or a vehicle. Shifting the lock from the locked configuration to the unlocked may include shifting a first auxiliary latch and a second auxiliary latch from an extended position to a retracted position. Shifting the lock from the locked configuration to the unlocked configuration may include shifting a main latch from a deadbolt position to a latched position. Moving the door panel from a closed position to the ajar position may include moving a main latch from a latched position to a retracted position.

In another embodiment of the present disclosure, a door system includes a door panel and a lock. The door panel is configured to pivot between closed position, an open position, and an ajar position. The ajar position is between the open position and the closed position. The lock is installed within the door panel. The lock is configured to move from a locked configuration to an unlocked configuration in response to receiving a signal or sensing a user. The door panel is configured to pivot from the closed position to the ajar position when the lock shifts from the locked configuration to the unlocked configuration.

In embodiments, the door system includes a door frame. The door panel may be supported by the door frame. The door frame may include a pressure sensor that is configured to provide a signal to the lock to transition the lock from the locked configuration to the unlocked configuration.

In some embodiments, the door system includes a sill partially underlying the door panel when the door panel is in the closed position. The sill may include a pressure sensor configured to provide a signal to the lock to transition the lock from the locked configuration to the unlocked configuration.

In certain embodiments, the door system includes a door opener that is configured to move the door panel from the closed position to the ajar position. The door opener may be a linear actuator, a motorized strike plate, an electromagnetic mechanism, or an electronic hinge.

In another embodiment of the present disclosure, a method of operating a door system includes sensing a user on an exterior side of a door panel in physical propinquity to the lock such that the lock transitions from a sleep state to an active state, authenticating the user when the lock is in the active state before converting the lock from a locked configuration to an unlocked configuration, and converting the lock from the locked configuration to the unlocked configuration in response to transition to the active state. Authenticating the user includes receiving an authentication signal from a remote device on the user in physical propinquity to the to the lock.

In embodiments, the method includes returning the lock to the locked configuration from the unlocked configuration. The lock may be returned to the locked configuration in response to the lock being manually converted to the locked configuration, receiving a signal to convert to the locked configuration, or after a predetermined amount of time has passed after a sensed event. Receiving the signal to shift to the locked configuration includes sensing a user in physical propinquity with the portion of the door panel remote from the lock.

In another embodiment of the present disclosure, a method of operating a door system includes transitioning a lock from a sleep state to an active state in response to sensing a user in physical propinquity with a portion of a door panel remote to accessible portions of the lock, and converting the lock from a locked configuration to an unlocked configuration after transitioning the lock to the active state.

In embodiments, the method includes authenticating a user when the lock is in the active state from converting the lock from the locked configuration to the unlocked configuration.

In another embodiment of the present disclosure, a method of operating a door system includes sensing, with a sensor of a lock, a user in physical propinquity to the lock such that the lock transition from a sleep state to an active state and converting the lock from a locked configuration to an unlocked configuration in response to transition to the active state.

In embodiments, the method may include authenticating the user when the lock is in the active state before converting the lock from the locked configuration to the unlocked configuration. Sensing the user in physical propinquity to the lock may include the user on an exterior side of a door panel. Authenticating the user includes receiving an authentication signal from a remote device on the user in physical propinquity to the lock.

In some embodiments, the method may include converting the lock from the locked configuration to the unlocked configuration includes translating an auxiliary latch from an extended position to a retracted position.

In certain embodiments, converting the lock from the locked configuration to the unlocked configuration includes translating a main latch of the lock from a deadbolt position to a latch position In particular embodiments, the method includes receiving physical input indicating manual rotation of a handle or a knob of the door system when the lock is in the unlocked configuration such that a main latch of the lock translates from a latched position to a retracted position such that a door panel is capable of moving to an open position.

In embodiments, the method includes returning the lock to the locked configuration from the unlocked configuration. The lock may be returned to the locked configuration in response to the lock being manually converted to the locked configuration, receiving a signal to convert to the locked configuration, or after a predetermined amount of time passes after a sensed event. Receiving the signal to convert the locked configuration includes sensing contact with a portion of a door panel remote from accessible portion of the lock. Receiving the signal to convert to the locked configuration includes receiving the signal from a remote device. The predetermined amount of time after the sensed event includes the sensed event being receiving physical input indicating manual rotation of a handle or a knob of the door system.

In some embodiments, the method includes sensing, with the sensor of the lock, a user in physical propinquity to the lock with the lock in the unlocked configuration such that the lock converts to the locked configuration.

In another embodiment of the present disclosure, a door system includes a door panel and a lock installed within the door panel. The lock including accessible portions which are accessible to a user without disassembly of the installed lock or the door panel. The lock is configured to transition from a sleep state to an active state in response to sensing a user in physical propinquity to the door panel remote from the accessible portions of the lock and to convert form a locked configuration to an unlocked configuration when in the active state.

In embodiments, the lock includes a control assembly disposed within the door panel. The control assembly may be configured to sense a user in physical propinquity with the door panel and receive signals from external devices. The door panel may include an interior surface and an exterior surface. The door panel may define a mortise channel between the interior surface and the exterior surface. The control assembly may be disposed within the mortise channel of the door panel.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
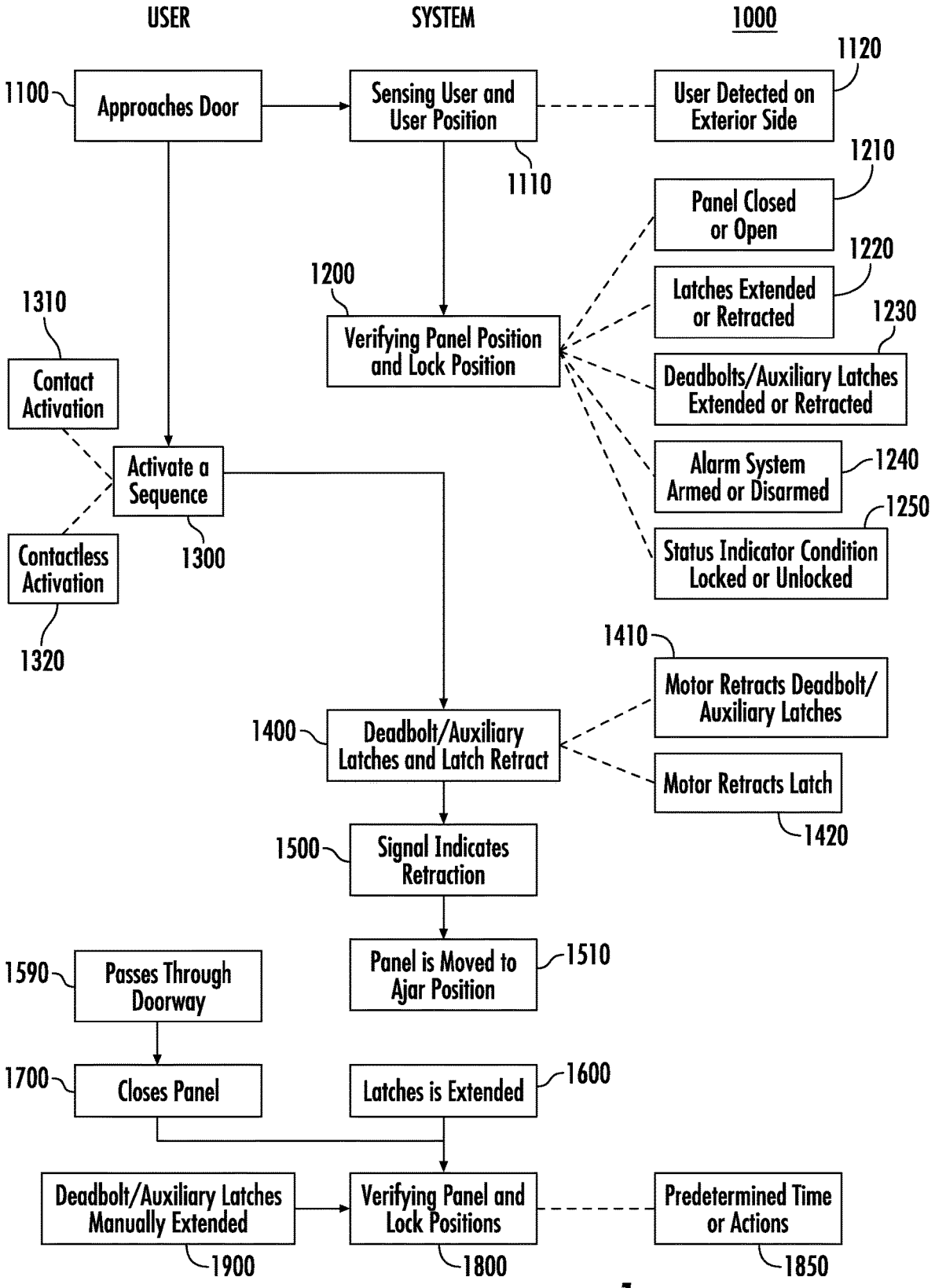
FIG. 1 is a flowchart of a method of opening a door provided in accordance with an embodiment of the present disclosure and means for performing each of the steps of the method.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

Figure 2:
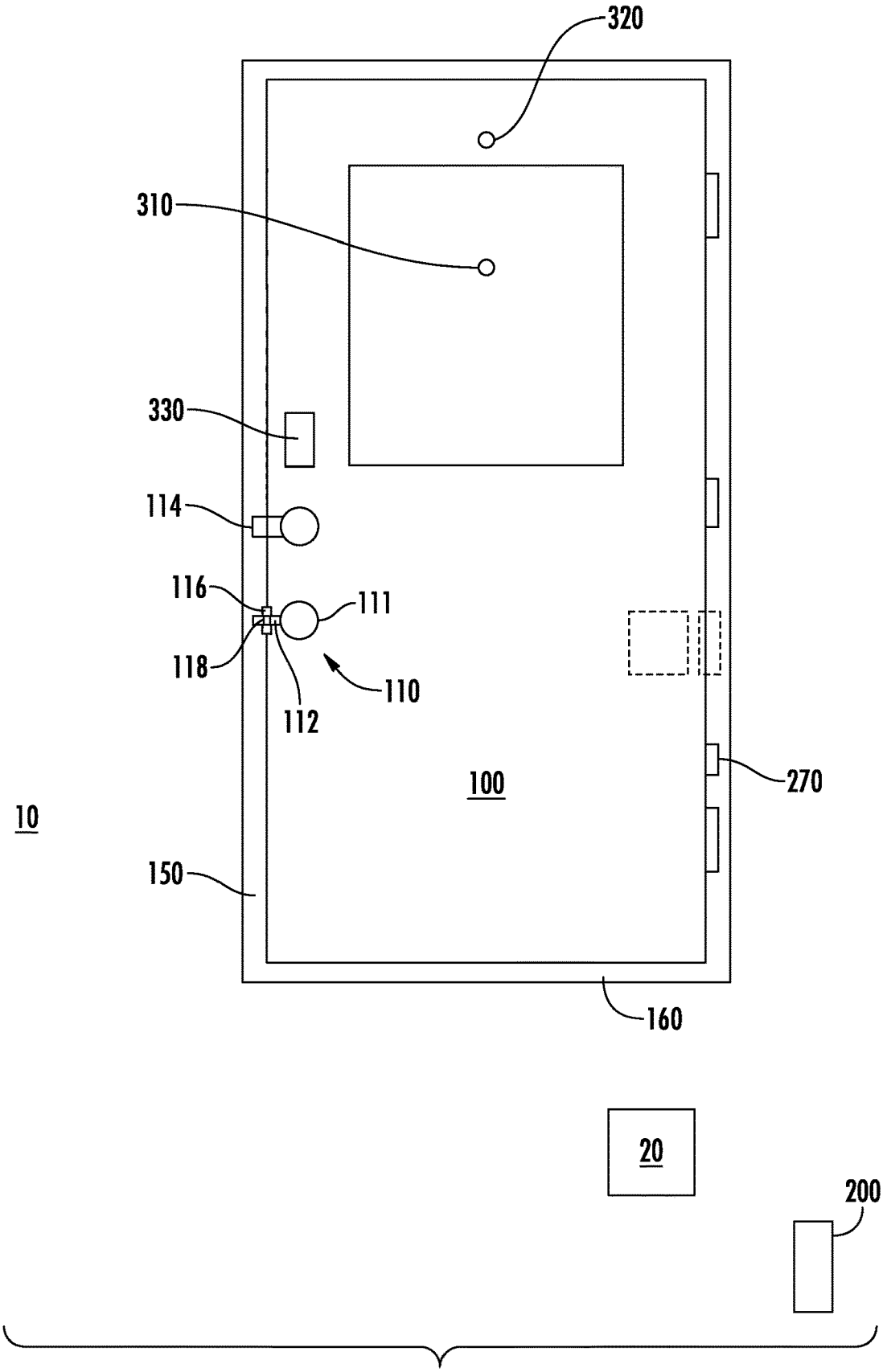
FIG. 2 is a schematic of a door system and components thereof provided in accordance with an embodiment of the present disclosure.

Referring now to FIG. 1, a method of opening a door is described in accordance with an embodiment of the present disclosure and is generally referred to as method 1000 with reference to the door system 10 of FIG. 2. The method 1000 is initiated or activated when a user approaches the door system 10 when the door system is in a closed or secured condition or position (Step 1100). In the closed condition of the door system 10, a latch 112 and/or a deadbolt 114 of the door system 10 are in an extended position thereof such that a door of the door system 10 is prevented from transitioning from a closed condition to an open condition. The door system 10 may include a multipoint locking mechanism including one or more auxiliary latches remote to the main latch 112. For example, the locking mechanism may include shoot bolts that extend from the top and bottom edges of the door 100 and/or may include an auxiliary latch spaced apart and above the main latch 112 and/or an auxiliary latch spaced apart and below the main latch 112. As detailed herein, the auxiliary latches or shoot bolts function in a manner similar to the deadbolt 114. The locking mechanism 110 may include a main latch 112 and a deadbolt 114 or may include a main latch 112 having a deadbolt position extended a first distance from the edge of the door 100, a latched position extended a second distance that is less than the first distance from the edge of the door, and a retracted position. In some embodiments, an alarm of a building or structure including the door system 10 may be in an armed state when the door system is in the closed condition.

The door system 10 may detect a user when the user is physically in front of the door system 10, e.g., within reach of the door system 10. This may occur with the user is within a range of 1 to 10 feet of a door. Additionally or alternatively, the door system 10 may detect a user when the user is in a general area of the door, e.g., approaching a building or once on a property including the door system 10.

Once the door system 10 is initialized or activated by a user approaching the door system 10, the door system 10 identifies the user and the user position (Step 1110). The door system 10 may detect, recognize, and/or identify an approaching user by a signal from a device 200 in possession or in the control of the user. The device 200 may be a portable electronic device including, but not limited to, a cell phone, a dedicated transmitter, a RFID device, or a near field communication device (NFC). The door system 10 may receive a signal from the device 200 from a suitable protocol including, but not limited to, Bluetooth®, Bluetooth® Low Energy (BLE), RFID, Geofencing, Wi-Fi, ZigBee, and Z-wave. In some embodiments, the signal may be generated by a garage door, a garage door opener, or a garage door opening device such as a garage door opener near the door system 10. In certain embodiments, the signal may be generated by a vehicle under the control of the user.

In particular embodiments, the door system 10 may include means for verifying physical characteristics of the user to identify the user. For example, the door system 10 may include a camera 310 that identifies a face, retina, or other physical characteristic of the user. The door system 10 may include a microphone 320 that identifies a voice of the user. The door system 10 may include a biometric reader 330 to identify a physical characteristic of the user, e.g., a fingerprint. When the door system 10 verifies physical features of the user, the physical characteristics of the user may need to be uploaded or preprogrammed into the door system 10. In some embodiments, the door system 10 may be in communication with a remote server to verify physical characteristics of the user. In some embodiments, the door system 10 may verify a user is positioned on an external side of the door (Step 1120).

When the user is identified, the door system 10 verifies the status or position of components of the door system 10 and/or the building to which the door system 10 is installed (Step 1200). The door system 10 may verify the condition of the door 100 of the door system 10 to determine if the door is in a fully closed condition or an open condition (Step 1210). The door system 10 may verify the position of a latch 112 of a locking mechanism 110, e.g., extended or retracted, (Step 1220) and may verify the position of a deadbolt 114 of the locking mechanism 110, e.g., extended or retracted (Step 1230). The door system 10 may verify a status of a security or alarm system of the building or structure including the door system 10, e.g., armed or disarmed (Step 1240). The door system 10 may provide visual or audible indicia to the user of the status of one or more of the components of the door system 10 or the building (Step 1250). The visual indicia may be a light, e.g., a light on the door 100 and/or one or more lights surrounding the door 100, and the audio indicia may be a chirp, tone, music, or other sound indicative of the status of one or more components of the door system 10.

With the user identified (Step 1110) and the status of the door system components verified (Step 1200), the door system 10 is prepared to be activated by the user (Step 1300). To activate the door system 10, the user may contact a portion of the door system 10 (Step 1310). The user may contact a portion of the door 100, a portion of a door frame 150 of the door 100, a sill 160 of the door 100, or other location adjacent the door 100, e.g., a wall. For example, the door system 10 may include a pressure sensor, a contact switch, a capacitance switch, or other suitable sensor for detecting contact from a user. In some embodiments, the door system 10 may include a sensor requiring a predefined amount of force or pressure before being activated by the user.

Additionally or alternatively, the door system 10 may be activated by a user via contactless means (Step 1320). The contactless means may include an ultrasonic signal, an IR signal, a light curtain sensor, audio recognition, or visual recognition. The contactless means may be included in the door 100, the frame 150, the sill 160, or other location adjacent the door 100. The contactless means may allow for detection of a user or a portion of the user in physical propinquity to the door system 10 or a portion of the door system 10. For example, the locking mechanism 110 may detect or sense a hand of a user near or adjacent a portion of the locking mechanism 110 or the door system 10. In some embodiments, the locking mechanism 110 may sense a hand of a user in physical propinquity to a portion of the door 100 above but remote to the lock mechanism 110.

When the identified user activates the door system 10 (Step 1300), the door system 10 transitions to an open condition (Step 1400). To move to the door 100 to the open condition, the lock mechanism 110 may retract the latch 112 and/or the deadbolt 114 to a retracted position. The door system 10 may include mechanical, electrical, or electromechanical means for transitioning the latch 112 and/or the deadbolt 114 to the respective retracted position (Steps 1410, 1420).

In some embodiments, in the open condition of the door system 10, an alarm or security system of the building or structure including the door system 10 is in a deactivated state such that when the door system 10 transitions to the open condition, the door system 10 sends a signal to the alarm or security system 20 to deactivate (Step 1430). The signal from the door system 10 to the security system 20 may be a wired or wireless signal.

In particular embodiments, in the open condition of the door system 10, the latch 112 and/or the deadbolt 114 may remain in the extended position and a strike plate 116 of the door system 10 may include one or more gates 118 that transition to an open state such that the latch 112 and/or the deadbolt 114 may pass through the respective gate 118 in the extended position as the door transitions from the closed position to the open position.

When the door system 10 is in the open condition, the door system 10 may provide visual or audio indicia that the door system 10 is in the open condition. The visual indicia may be a light, e.g., a light on the door 100 and/or one or more lights surrounding the door 100, and the audio indicia may be a chirp, tone, music, or other sound indicative of the status of one or more components of the door system 10. In certain embodiments, a visual indicium may be the door 100 transitioning to an open or ajar condition. In such embodiments, the door system 10 may include an actuator 270 that is configured to move the door 100 from a fully closed condition to an open condition (Step 1510). The open condition may be in a range from slightly ajar, e.g., 1 degree to 5 degrees of rotation, to fully open. The actuator 270 may include, but not be limited to, a linear actuator, an element in the strike plate, an electromagnetic mechanism, a stepper motor, or a spring release. For example, the actuator 270 may be a gate 118 in the strike plate 116 that opens such that the door 100 can be opened without the use of the handle 111. In some embodiments, the door 100 is biased towards the open condition such that when the gate 118 is opened, the door 100 rotates to be slightly ajar.

When the door system 10 is in the open or ajar condition, a user may pass through the door 100 without engaging the lock mechanism 110 of the door 100 (Step 1590), e.g., unlocking the deadbolt 114, retracting the latch 112, engaging the handle 111. For example, a user may apply slight pressure to the door 100 to move the door 100 from the closed condition or the ajar condition towards an open condition to allow the user to pass through the door 100. In embodiments where the door system 10 includes an actuator 270 to move the door to an open position, the user may pass through the door 100 without contacting the door 100 or may move the door from the ajar condition towards a fully open condition.

Once the door 100 is in an open condition, either by the door system 10 moving the door 100 or from a user moving the door 100, the door system 10 returns the latch 112 and/or gate 118 associated with the latch 112 to an operating position thereof (Step 1600), e.g., extended position for the latch 112 or closed state for the gate 118. With the latch 112 and the gate 118 in the operating position, the door 100 operates with the handle 111 such that when the door 100 is in a closed condition, the door 100 remains in the closed condition until the handle 111 is actuated to retract the latch 112. After the user passes through the door 100, the user may close the door 100 (Step 1700).

After the user closes the door 100, the door system 10 may determine positions and/or states of various components of the door system 10 (Step 1800) and may change positions/or states of various components of the door system 10 based on predetermined instructions (Step 1850). For example, the door system 10 may determine the position of the deadbolt 114 when the door 100 is closed and may transition the deadbolt 114 from the retracted position to the extended position after a predetermined time passes from the door 100 being in the closed condition. The predetermined time may be in a range of 0 seconds to twenty-four hours. Similarly, a gate 118 associated with the deadbolt 114 may transition from an open state to a closed state when the door 100 after a predetermined time passes. In particular embodiments, the door system 10 may send a signal to an alarm system to arm after a second predetermined time passes. The second predetermined time may be different than the predetermined time for transitioning the deadbolt 114. The door system 10 may provide visual and/or audio indicia when the deadbolt 114, the gate 118, or the alarm system are transitioned.

In some embodiments, the deadbolt 114 may be manually transitioned from the retracted position to the extended position (Step 1900). When the door system 10 detects the deadbolt 114 being transitioned to the extended position, the door system 10 may transition to a closed condition such that the latch 112 is in the extended position. In certain embodiments, when the deadbolt 114 is manually transitioned to the extended position, the door system 10 may send a signal to an alarm system to arm.

In embodiments of the method 1000, the door system 10 may receive and/or send signals to the portable electronic device 200 or to other computer systems remote to the door system 10. For example, the door system 10 may receive a signal from the portable electronic device 200 to transition the latch 112 or the deadbolt to the extended or retracted position thereof. Additionally, or alternatively, the door system 10 may send signals to provide a state of the door system 10. For example, the door system 10 may send a signal to the portable electronic device 200 that the condition of the door system 10 changed from a closed condition to an open condition or vice versa. The door system 10 may communicate to the portable electronic device 200 directly or through an internet connection. The door system 10 may be connected to the internet through a wired connection, or a wireless connection, to communicate with the portable electronic device 200.

Figure 3:
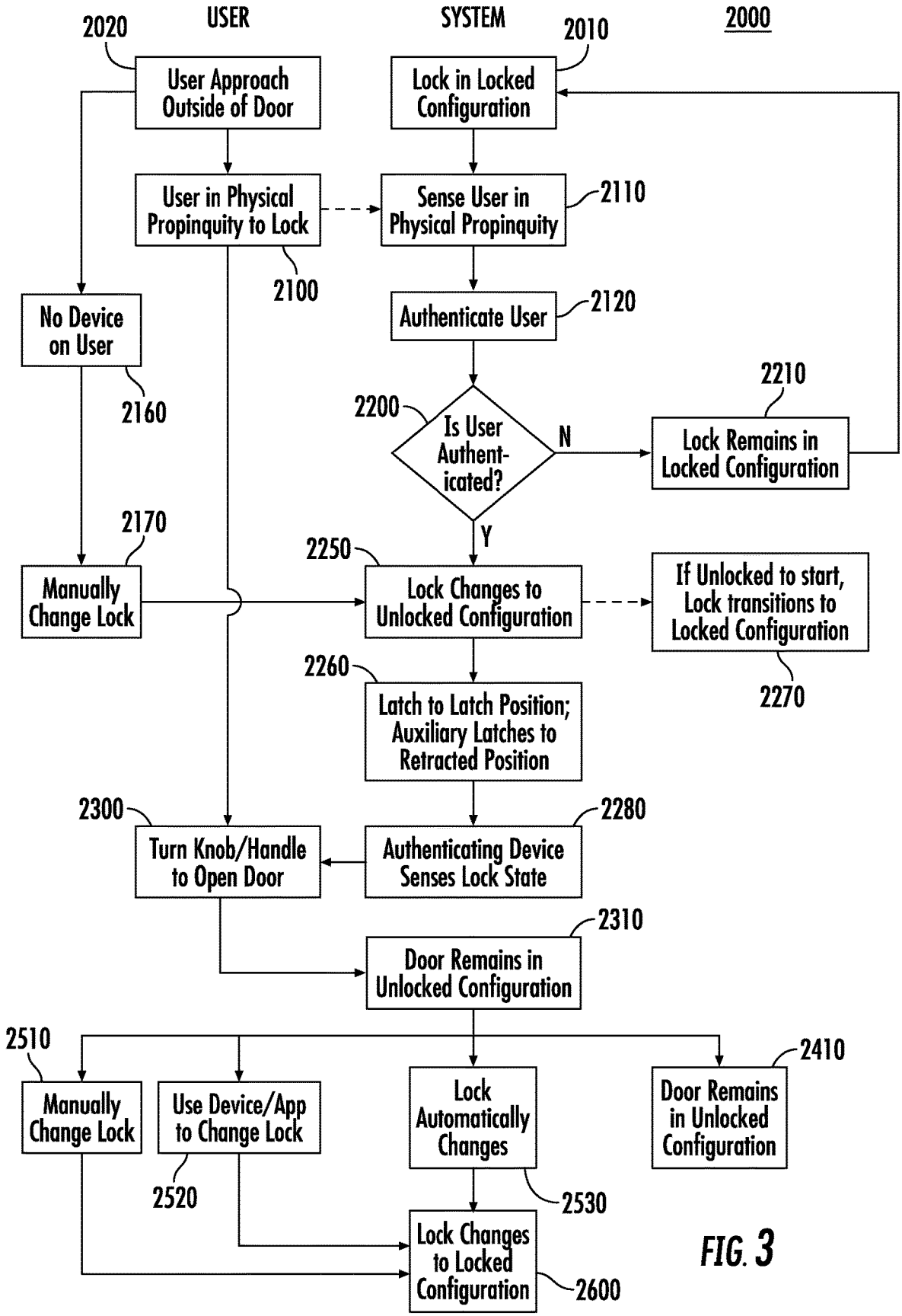
FIG. 3 is a flowchart of a method of operating a door provided in accordance with an embodiment of the present disclosure.

Referring now to FIG. 3, a method 2000 of operating a lock mechanism of a door is described in accordance with an embodiment of the present disclosure with reference to the door system 10 of FIG. 2. The method 2000 begins with a user approaching the door system 10 from an exterior side of the door system 10 (Step 2020). When the user reaches the door system 10, the user touches the door 100 of the door system 10 (Step 2100). The user may touch anywhere on the door 100 or the door system 10 may require the user to touch a specific location on the door 100 (Step 2100), e.g., a panel on the door 100, a deadbolt mechanism of the door 100, or a handle of the door 100. The specific location of the door 100 may be remote to accessible portions of the lock mechanism 110, e.g., portions of the lock mechanism 110 that are exposed without disassembly of the lock mechanism or the door 100. For example, the user may touch the door panel above the deadbolt mechanism.

In some embodiments, the user not be required to contact or touch the door 100. Specifically, the user may approach the door 100 and be in physical propinquity with a portion of the door 100 that is remote to the lock mechanism 110. For example, the user may approach the door 100 and position their hand in physical propinquity to the deadbolt mechanism or a portion of the door 100 above the deadbolt mechanism such that the lock mechanism senses or detects the user's hand (Step 2100). To be within physical propinquity a portion of the user may be required to be within 1 inch to 1 foot of a sensor disposed within the door 100, e.g., within 1 inch to within 3 inches of the sensor.

In response to the user touching the door panel or being within physical propinquity to the sensor, an authenticating device of the door system 10 moves from a sleep state to an active state (Step 2110). When the authenticating device is in the active state, the authenticating device listens or receives an authenticating signal from a device 200 of the user, e.g., a portable electronic device, a phone, or a Bluetooth device. In response to receiving an authenticating signal from a device 200 of the user, the authenticating device determines the position of the device 200 of the user, e.g., on an interior side or an exterior side of the door 100 (Step 2120). When the authenticating device is in the active state and the location of the device 200 of the user is determined, the authenticating device determines if the user is authenticated (Step 2200). Specifically, if the authenticating device determines that the device 200 of the user is on the exterior side of the door 100, the locking mechanism 110 of the door transitions or shifts from the locked configuration to an unlocked configuration (Step 2250). To transition the locking mechanism 110 to the unlocked configuration, the locking mechanism 110 may transition a latch 12 from a deadbolt position to a latched position and/or may transition one or more auxiliary latches from an extended position to a retracted position (Step 2260). Alternatively, if the authenticating device determines that the device 200 of the user is not on the exterior side of the door 100, the locking mechanism 110 of the door 100 remains in the locked configuration (Step 2210). To transition the locking mechanism 110 of the door 100 to the unlocked configuration, the authenticating device may require the device 200 of the user to be within a predetermined distance on the exterior side of the door 100, e.g., 1 foot, 2 feet, 5 feet, 10 feet. In some embodiments, if the locking mechanism 110 of the door 100 is in an unlocked configuration and the user touches the door 100 and the device 200 of the user is on the exterior side of the door 100, the locking mechanism 110 of the door 100 transitions from the unlocked configuration to a locked configuration (Step 2270).

In some embodiments, when the authenticating device is unable to determine the location of the device 200 of the user or the location of the device 200 is determined to be on an interior side or out of range of the door 100 (Step 2160), the user may use a key to manually transition the locking mechanism 110 from the locked configuration to the unlocked configuration (Step 2170).

When the lock mechanism 110 transitions from the locked configuration to the unlocked configuration, or the unlocked configuration to the locked configuration, the authenticating device senses or records the new configuration of the locking mechanism 110 (Step 2280). With the locking mechanism 110 in the unlocked configuration, the user may turn the knob or handle 111 to retract the latch 112 of the door 100 to open the door 100 (Step 2300). After the door 100 is opened, the locking mechanism 110 may remain in the unlocked configuration (Step 2310). The user may do nothing such that the locking mechanism 110 remains in the unlocked configuration (Step 2410).

The user may desire to lock the door 100 after opening or entering the door 100. To lock the door 100, the user may manually lock the door 100 using a key or a thumb turn (Step 2510). In some embodiments, the user may use the device 200 to lock the door 100 (Step 2520). Specifically, the user may use an app or a button on the device 200 to lock the door 100. In certain embodiments, the door 100 may automatically lock after a predetermined amount of time or after the device 200 is sensed on the interior side of the door 100 (Step 2530). In particular embodiments, a position of the door 100 may be sensed before transitioning the locking mechanism 110 to the locked configuration in either Step 2520 or Step 2530 such that the locking mechanism 110 is only transitioned to the locked configuration when the door 100 is in a closed position. In response to any of the options for transitioning the lock to the locked configuration, the lock transitions to the locked configuration (Step 2600).

Figure 4:
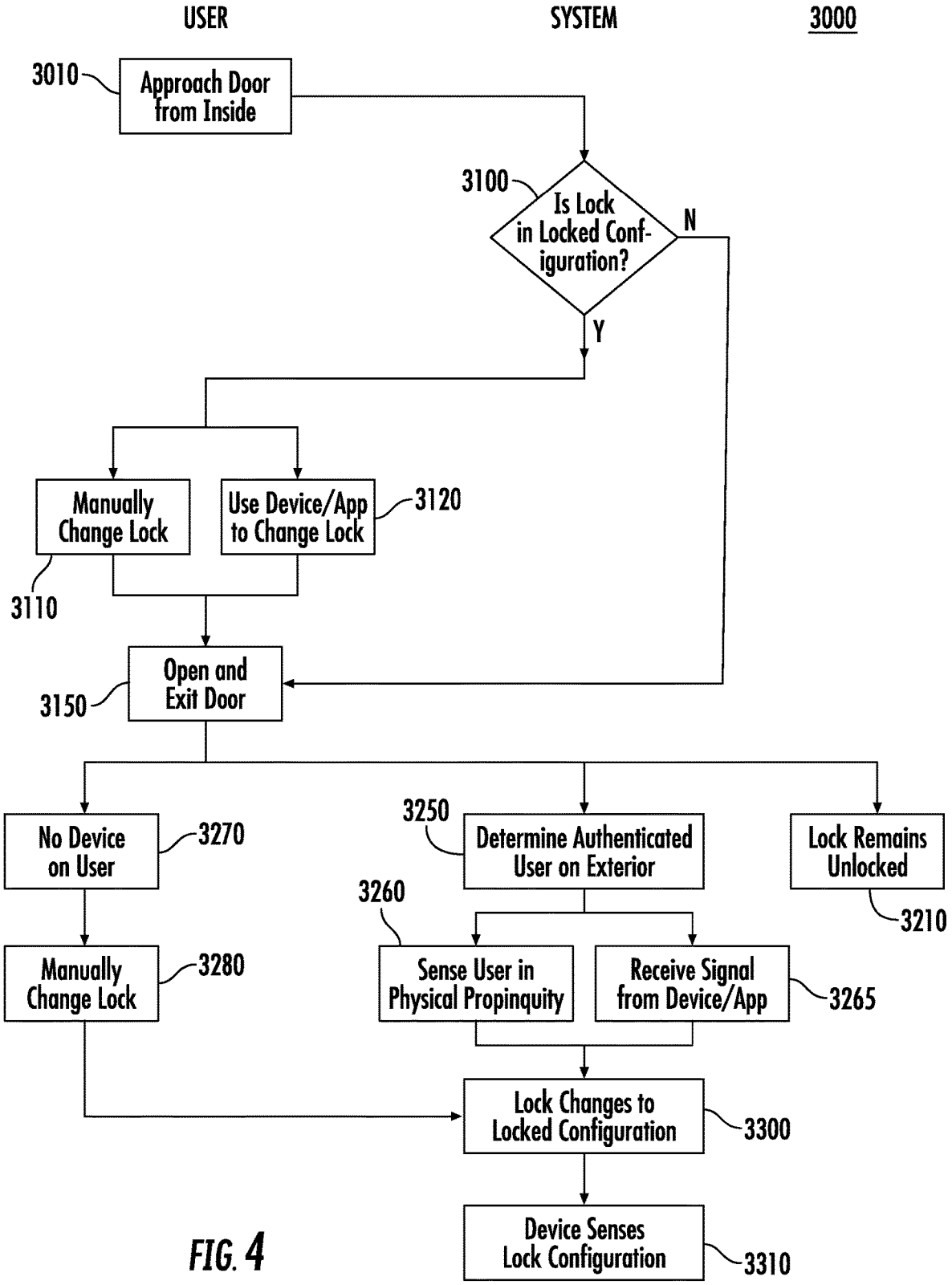
FIG. 4 is a flowchart of another method of operating a door provided in accordance with an embodiment of the present disclosure.

With reference to FIG. 4, a method 3000 of operating a lock mechanism of a door is described in accordance with an embodiment of the present disclosure with reference to the door system of FIG. 2. The method 300 begins with a user approaching the door system 10 from an interior side of the door system 10 (Step 3010). When the user approaches the door system 10 from the interior side with the locking mechanism 110 of the door in a locked configuration, the user may manually unlock the door (Step 3110) or the user may unlock the door by a device 200 (Step 3120). To manually unlock the door (Step 3110), the user may use a thumb turn or a key. To use the device 200 to unlock the door (Step 3120), the user may press a button on the device 200 or may use an app on the device 200 to unlock the door 100. When the locking mechanism 110 is transitioned to the unlocked configuration, the user may open the door 100 and exit through the door 100 (Step 3150). In some embodiments, the locking mechanism 110 is unlocked as the user approaches the door 100 such that the door does not need to be unlocked before the user opens the door 100 and exits (Step 3150). The user may open the door 100 and exit by actuating a handle or a knob of the door 100.

After the user exits, the user may want to keep the locking mechanism in the unlocked configuration such that the user takes no action to lock the door (Step 3210). In other embodiments, the user may want to transition the locking mechanism 110 to the locked configuration after exiting through the door 100. In such embodiments, the authenticating device of the door system 10 may receive a signal from the device 200 and determine that the device 200 is on the exterior side of the door 100. The authenticating device may require the device 200 to be within a predetermined distance of the door 100 on the exterior side of the door 100, e.g., 1 foot, 2 feet, 3 feet, 4 feet, 5 feet, or 10 feet, to authenticate the user (Step 3250). When the user is authenticated, the user may touch the door 100 at any or a specific location, e.g., a panel on the door 100, a deadbolt mechanism, or the handle, to transition the locking mechanism 110 to a locked configuration (Step 3260). Similarly, the user may be place a portion of their anatomy, e.g., a hand, in physical propinquity to a portion of the door 100 such that the locking mechanism transitions to the locked configuration (Step 3260). In some embodiments, the user may use the device 200 to transition the locking mechanism 110 to the locked configuration (Step 3260). The user may use a button the device 200 or an application on the device 200 to transition the locking mechanism 110 to the locked configuration. In certain embodiments, the user may exit through the door 100 without the device 200 or the authenticating device may not determine the location of the device 200 to be on the exterior side of the door 100 (Step 3270). In such embodiments, the user may manually transition the locking mechanism 110 of the door 100 to the locked configuration with a key (Step 3280). When the door transitions to the locked configuration (Step 3300), the authenticating device senses and/or records a new state of the locking mechanism 110 (Step 3310).

In certain embodiments, the deadbolt or auxiliary latch of the locking mechanism 110 may engage if the door remains in an open position or the locking mechanism 110 may prevent the deadbolt or auxiliary latch from engaging when the door is in the open position. The locking mechanism 110 may include one or more sensors that determine the configuration of the locking mechanism 110, e.g., the unlocked configuration or the locked configuration. The locking mechanism 110 may send a signal to the device 200 if the locking mechanism 110 is unable to transition to the locked configuration after a predetermined number of attempts, e.g., 2 attempts. For example, the locking mechanism 110 may fail to transition to the locked configuration if the door 100 is in an open position or if the path of travel of the deadbolt or auxiliary latch is obstructed.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed is:

1. A method of operating a door system, the method comprising:

sensing, with a sensor of a lock, a user on an exterior side of a door panel in physical propinquity to the lock such that the lock transitions from a sleep state to an active state;

authenticating the user when the lock is in the active state before converting the lock from a locked configuration to an unlocked configuration, authenticating the user includes receiving an authentication signal from a remote device on the user in physical propinquity to the lock; and converting the lock from the locked configuration to the unlocked configuration in response to receiving the authentication signal.

2. The method according to claim 1, further comprising returning the lock to the locked configuration from the unlocked configuration in response to:

the lock being manually converted to the locked configuration;

receiving a signal to convert to the locked configuration; or a predetermined amount of time passing after a sensed event.

3. The method according to claim 2, wherein receiving the signal to shift to the locked configuration includes sensing a user in physical propinquity with the portion of the door panel remote from the lock.

4. The method according to claim 1, wherein converting the lock from the locked configuration to the unlocked configuration includes translating an auxiliary latch from an extended position to a retracted position.

5. A method of operating a door system, the method comprising:

sensing, with a sensor of a lock, a user in physical propinquity to the lock such that an authentication device of the lock transitions from a sleep state to an active state;

listening for an authentication signal, with the authentication device in the active state, before converting the lock from the locked configuration to the unlocked configuration; and authenticating the user in physical propinquity with the authentication device in the active state such that the lock converts from a locked configuration to a unlocked configuration.

6. The method according to claim 5, wherein sensing the user in physical propinquity to the lock includes sensing the user on an exterior side of a door panel.

7. The method according to claim 6, wherein authenticating the user includes receiving an authentication signal from a remote device on the user in physical propinquity to the lock.

8. The method according to claim 5, wherein converting the lock from the locked configuration to the unlocked configuration includes translating an auxiliary latch from an extended position to a retracted position.

9. The method according to claim 5, wherein converting the lock from the locked configuration to the unlocked configuration includes translating a main latch of the lock from a deadbolt position to a latch position.

10. The method according to claim 9, wherein converting the lock from the locked configuration to the unlocked configuration includes transitioning a first auxiliary latch and a second auxiliary latch from an extended position to a retracted position.

11. The method according to claim 5, further comprising receiving physical input indicating manual rotation of a handle or a knob of the door system when the lock is in the unlocked configuration such that a main latch of the lock translates from a latched position to a retracted position such that a door panel is capable of moving to an open position.

12. The method according to claim 5, further comprising returning the lock to the locked configuration from the unlocked configuration in response to:

the lock being manually converted to the locked configuration;

receiving a signal to convert to the locked configuration; or a predetermined amount of time passing after a sensed event.

13. The method according to claim 12, wherein receiving the signal to convert to the locked configuration includes sensing contact with a portion of a door panel remote from accessible portions of the lock.

14. The method according to claim 12, wherein receiving the signal to convert to the locked configuration includes receiving the signal from a remote device.

15. The method according to claim 12, wherein the predetermined amount of time after the sensed event includes the sensed event being receiving physical input indicating manual rotation of a handle or a knob of the door system.

16. The method according to claim 5, further comprising sensing, with the sensor of the lock, a user in physical propinquity to the lock with the lock in the unlocked configuration such that the lock converts to the locked configuration.

17. A door system comprising:

a door panel; and a lock installed within the door panel, the lock comprising accessible portions which are accessible to a user without disassembly of the installed lock or the door panel, the lock configured to convert from a locked configuration to an unlocked configuration by transitioning from a sleep state to an active state in response to sensing a user in physical propinquity to the door panel remote from the accessible portions of the lock, authenticating the user, and converting from the locked configuration to the unlocked configuration when in the active state in response to authentication of the user.

18. The door system according to claim 17, wherein the lock includes a control assembly disposed within the door panel, the control assembly configured to sense a user in physical propinquity with the door panel and receive signals from external devices.

19. The door system according to claim 18, wherein the door panel include an interior surface and an exterior surface and defines a mortise channel between the interior surface and the exterior surface, the control assembly disposed within the mortise channel of the door panel.

* * * * *